US005376017A

United States Patent [19]

Taniuchi et al.

[11] Patent Number: 5,376,017

[45] Date of Patent: Dec. 27, 1994

[54] CONNECTOR

[75] Inventors: Osamu Taniuchi; Youichi Nankoh, both of Yokkaichi, Japan

[73] Assignee: Sumitomo Wiring Systems, Ltd., Yokkaichi, Japan

[21] Appl. No.: 110,728

[22] Filed: Aug. 23, 1993

[30] Foreign Application Priority Data

Sep. 29, 1992 [JP] Japan ..... 4-067784[U]
Sep. 29, 1992 [JP] Japan ..... 4-067785[U]

[51] Int. Cl.[5] ..... H01R 13/62
[52] U.S. Cl. ..... 439/372; 439/489
[58] Field of Search ..... 200/51.09–51.11; 439/188, 372, 374, 488, 489, 509, 350, 352, 354, 357, 358

[56] References Cited

U.S. PATENT DOCUMENTS 4,871,325 10/1989 Maejima et al. ..... 439/372 X
4,878,853 11/1989 Yamade et al. .
4,884,978 12/1989 Inaba et al. .
4,915,648 4/1990 Takase et al. ..... 439/489 X
5,017,147 5/1991 Sugiyama et al. ..... 439/372 X
5,035,644 7/1991 Nakazato et al. ..... 439/188 X
5,135,408 8/1992 Suzuki ..... 439/372 X
5,174,785 12/1992 Endo et al. ..... 439/372 X

*Primary Examiner*—Khiem Nguyen
*Attorney, Agent, or Firm*—Sandler, Greenblum & Bernstein

[57] ABSTRACT

A lever with a projecting part is rotatably mounted to the female connector via a supporting shaft. The lever has a projecting part entering in a fitting hole formed therein and butts against a strut formed in the male connector at the fitting time, thereby to turn the lever to the operating position and further press the strut when the lever is turned from the operating position, so that the male and female connectors are perfectly engaged with each other. Thus, the degree of freedom of the position of a lever before engaging male and female connectors is improved. Moreover, a first locking means is arranged for the male and female connectors to lock the connectors at the temporary engaging position where the lever is turned at the operating position, and a second locking means is provided for the lever and the other connector to lock the connectors when the lever is turned to the real engaging position.

6 Claims, 4 Drawing Sheets

CONNECTOR

BACKGROUND OF THE INVENTION

1. Field of the Invention

The present invention relates to a connector with a lever used to reduce the force required for a male-female connection between a device connector and a power connector thereby to double-lock both connectors and, more particularly, to a connector having a short-circuiting mechanism incorporated in the device connector for keeping the parallel terminals accommodated therein short-circuited, in which such short-circuit is released by operation of the lever.

2. Description of the Prior Art

The inspection and maintenance work or wiring work of an electric circuit connected to an air bag or the like of the automobile should be carried out without actuating the air bag or the like. When the connectors on the power side and the device side are not engaged with each other, conventionally, terminals of a connector housing on the side of the device connected to the air bag are short-circuited via a short-circuiting member so as not to allow an induced current by the external magnetic field or electric field to flow to the device, thereby to prevent an erroneous operation of the air bag. The short-circuit is relieved when the connector on the device side is connected with the connector on the power side.

In this kind of connector incorporating a short-circuiting function as referred to above, a short-circuit releasing member is provided in the power side connector so as to move the above short-circuiting member to a releasing position when the connectors are engaged with each other.

Meanwhile, a lever-type connector has been recently offered to easily engage multi-terminal connectors (including, for example, more-than twenty terminals), because a relatively small force is enough to couple the connectors due to the leverage.

A lever is rotatably mounted to one of the male and female connectors of the lever-type connector via a supporting shaft. When the lever is turned, the other connector is forcibly moved in a direction to be engaged with the one connector. More specifically, while the male and female connectors are temporarily locked, a guide pin projecting from the other connector is inserted into a guide groove of the lever positioned at a predetermined position to the one connector. Then, as the lever is turned in the above state, the other connector is moved into a fitting hole of the one connector, and thus the male and female connectors are coupled with each other.

The U-shaped lever before the connectors are engaged with each other is generally located at such position that the operating part at the central coupling section of the lever is turned above the connectors while a supporting point in the axial direction at either side of the lever works as a fulcrum. A positioning means such as a spring or the like is additionally provided to keep the lever at that location.

As described hereinabove, in the connector incorporating a short-circuiting mechanism, it is necessary to provide the short-circuit releasing member on the power side connector and moreover, constitute the short-circuiting member on the device side connector in an engageable construction with the short-circuit releasing member. Therefore, both connectors become complicated in structure, causing a serious limitation in the degree of freedom of the design.

Since the lever generally projects from the connectors at the specific position before the engagement of the connectors, the storage, transfer or the like of the lever demands considerable space. Moreover, it is most likely at a narrow place, etc. that the lever may be brought in touch with the other different parts and erroneously turned before the connectors are engaged with each other.

If the lever is not turned without the male and female connectors being locked at a specific temporary engaging position, it is not possible to perfectly couple the connectors by the lever. However, the temporary engaging state may sometimes be difficult to confirm by eye depending on the setting position of the connectors. In general, the prior art connector system is not so adapted as to judge with a sense of moderation when the connectors are located at the temporary engaging position. Therefore, the lever may be inadvertently turned although the connectors are not temporarily locked with each other, thus necessitating the re-engagement of the connectors and lowering the fitting efficiency.

Further, since it is yet possible to turn the lever to the real engaging position-even if the connectors are not correctly temporarily locked with each other, and it cannot be easily detected when the engagement of the connectors is not effected, for example, when the engagement is missed although the connectors are moved to the real engaging position, it may be erroneously so judged only through the manipulation of the lever, particularly in the case where the lever is moved a small distance, that the perfect engagement of the connectors is completed.

Moreover, if the assisting lever is to be mounted in the above connector, an additional arrangement to change the connector in the lever type is needed and the connector is consequently furthermore complicated in structure.

Particularly, according to the lever-type connector, it is impossible to engage the mating connectors unless the lever is held at a specific position. If the lever is out of the specific position due to some reason during the storage, transfer or assembly, the connectors cannot be coupled to one another.

SUMMARY OF THE INVENTION

The object of the present invention is therefore to provide a connector which solves these problems.

The present invention has been developed with a view to substantially solving the above described disadvantages and has for its essential object to provide an improved connector.

In order to achieve the aforementioned objective, a connector for connecting a first terminal and a second terminal comprises a first connector member for accommodating said first terminal therein and provided with first engaging means and first positioning means; lever means pivotally provided on said first connector member, said lever means being provided with a pressing means; and a second connector member for accommodating said second terminal therein and provided with second engaging means engageable to said first engaging means, third engaging means engageable to said pressing means, and second positioning means engageable to said first positioning means for holding said first connector member and said lever means, said lever means being movable between a first predetermined position, in which said first and second connecter members are temporality contacted, and a second predetermined position, in which said third engaging means is pressed by said pressing means along said first engaging means so that said second connector member is firmly engaged with said first connector means.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENT

Figure 2A:
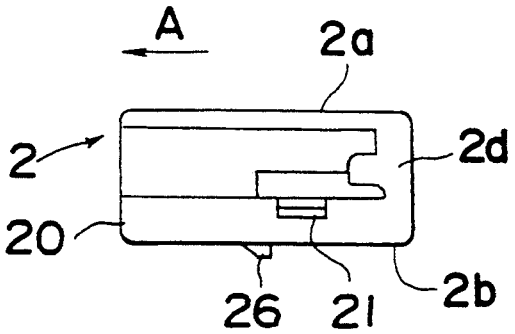
FIG. 2A is a plan view showing a male connector, according to the embodiment of the present invention, applied to the electric device.
Figure 2B:
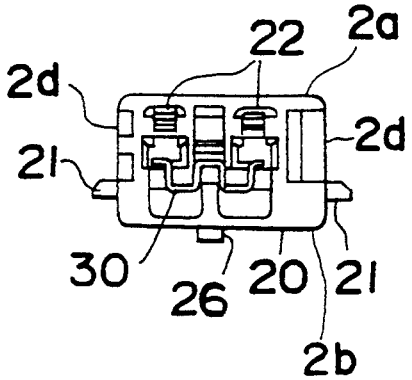
FIG. 2B is a side view of the male connector viewed from the left side in FIG. 2A.

Referring to FIGS. 2A and 2B, a plug connector 2 connected to an electric or electronic device (not shown), herein after referred to as "a device connector", is shown. The device connector 2 is generally in a rectangular box shape defined by top wall 2*a*, bottom wall 2*b*, and side walls 2*d*, extending between first end (shown on the right side in FIG. 2A) and second end, is shown. The device connector 2 has a rectangular shape in cross-section.

Figure 3:
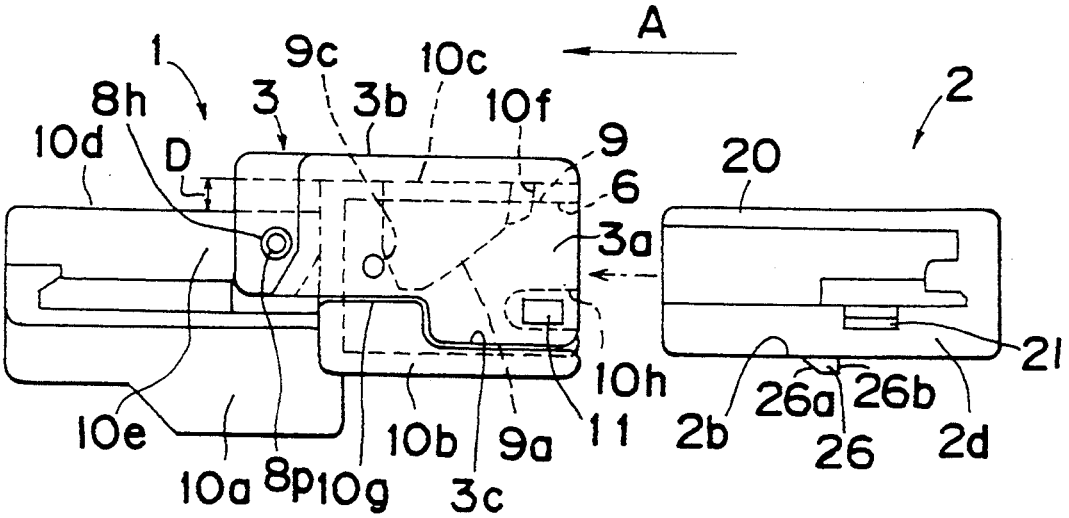
FIG. 3 is a plan view showing male and female connectors, before being connected with each other, shown in FIGS. 1A and 2A, respectively.

The device connector 2 is provided with a pair of engaging projections 21 projecting at the outer surface of each side wall 2*d*, and is further provided with a temporary engaging projection 26 formed to project from the bottom wall 2*b*. The temporary engaging projection 26 is formed to project approximately from the center of the lower surface of the bottom wall 2*b*. The temporary engaging projection 26 has a tapered surface 26*a* inclining at the insertion side toward the first end thereof, and further has an engaging surface 26*b* extending downward at the opposite side to the tapered surface 26*a*, as best shown in FIG. 3.

Figure 4:
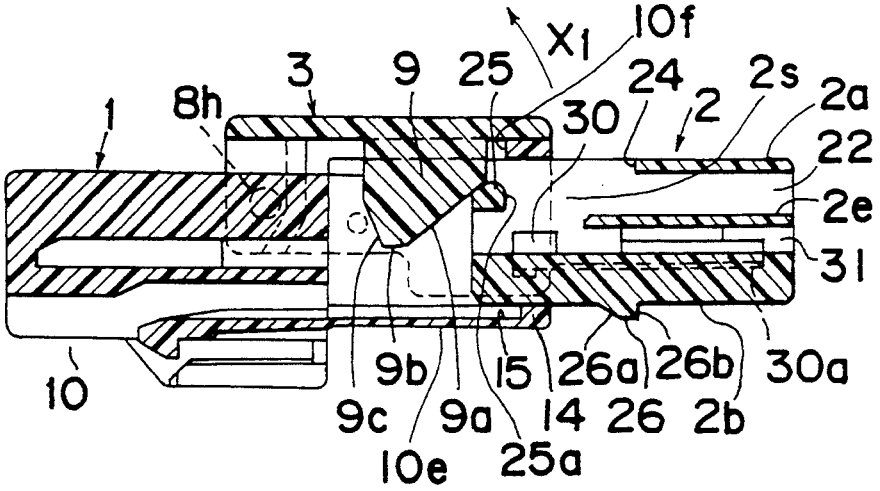
FIG. 4 is a cross-sectional view showing the connection of male and female connectors, before being temporarily engaged with each other, shown in FIG. 3.

Referring to FIG. 4, the device connector 2 provided with a center wall 2*e* extending between the top wall 2*a* and bottom wall 2*b*. The center wall 2*e* extends from the first end by a predetermined length and reaches before the second end of the device connector 2, so that the inner space of the device connector 2 is divided into three portions; an upper space and a lower space 31 formed on the opposite sides of the center wall 2*e*, and a connection space 2S formed between the center wall 2*e* and the second end of device connector 2. The upper space is divided by a separation wall (not shown) into a plurality of first terminal chambers 22 each extending in parallel to others, but only two chambers 22 are shown in FIG. 2B for the sake of brevity.

Figure 5A:
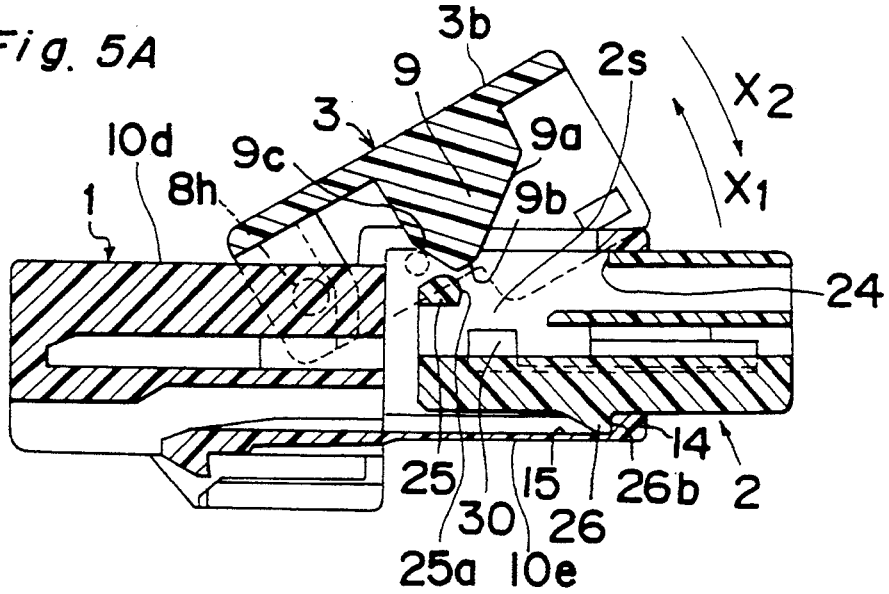
FIG. 5A is a view similar to FIG. 4, but particularly showing male and female connectors temporarily engaged with each other.
Figure 5B:
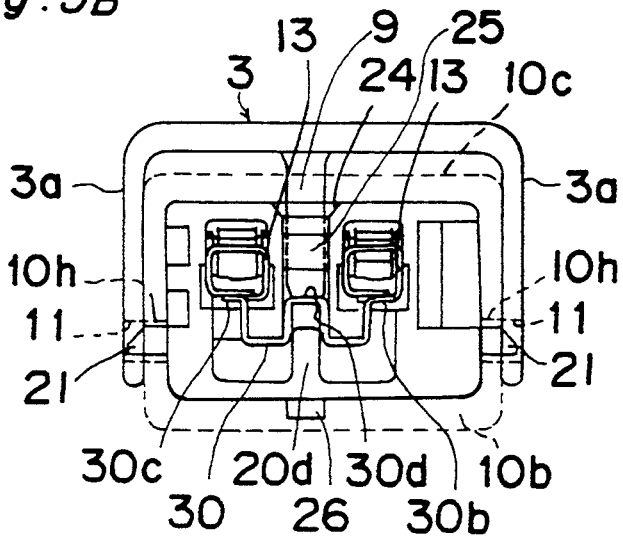
FIG. 5B is a side view showing the connection of lever and male connector which are temporarily engaged.
Figure 6A:
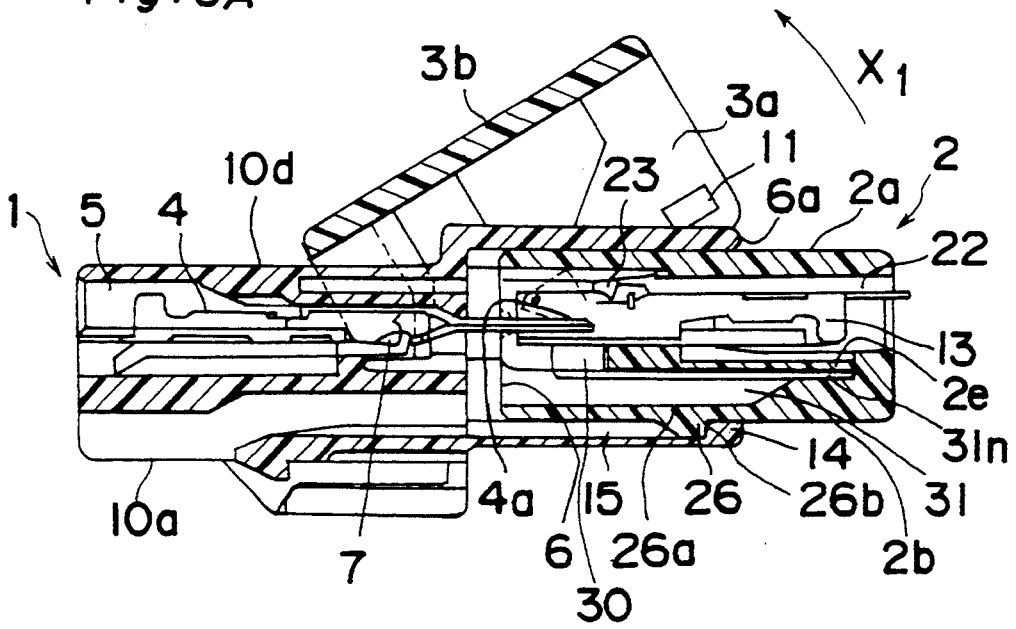
FIG. 6A is a cross-sectional view showing another section of the connectors in the temporarily engaged state.
Figure 6B:
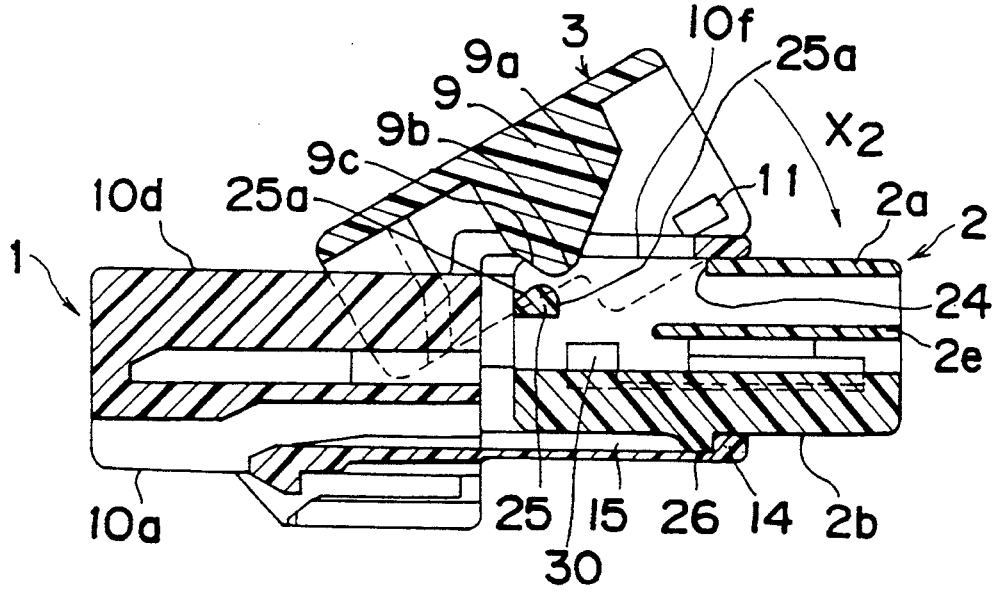
FIG. 6B is a view similar to FIG. 6A, but particularly showing the other section of the connectors.

Referring to FIG. 6A, a lance 23 formed in the inner surface of the terminal chamber 22 below the top wall 2*a* is shown. A female terminal 13 is accommodated inside each of first terminal chambers 22, fixed by the lance 23, such that one end portion of the female terminal 13 protrudes into the connection space 2S. The bottom wall 2*b* partially rises up near the first end portion to reduce the lower space 31 vertically and a narrow space 31*n* is formed under the center wall 2*e* thereat. Thus, an elongated chamber 31 having narrow space 31*n* at the first end portion is formed under the first terminal chambers 22. A guide part 20*d* projecting upward is formed on the center of the bottom wall 2*b* between the first terminal chambers 22, as best shown in FIG. 5B.

Referring back to FIG. 4, a short-circuiting member 30 formed of an elastic metallic plate preliminarily mounted in the elongated chamber 31 is shown. The short-circuiting member 30 is comprised of a touching member and an elongated plate member. The touching member has a generally W-shape in a cross-section, as best shown in FIG. 2B, and is formed on the one end of the elongated plate member. An upwardly bent part of the touching member is formed at each side part and the central part of the other free end of the plate member. Thus formed short-circuiting member 30 is accommodated in the third chamber such that the elongated spring portion is inserted in the narrow space 31*n* and the touching member urged upward. Then, the touching member is in press contact with the lower surface of the female terminal 13 over the center wall 2*e*, so that female terminals 13 are short-circuited.

Figure 7A:
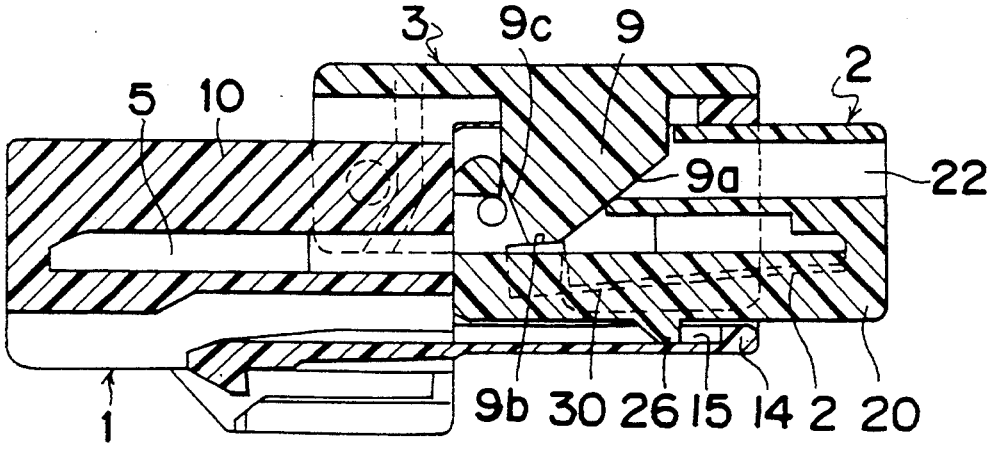
FIG. 7A is a view similar to FIG. 5A, but particularly showing the lever and male connector perfectly engaged with each other.
Figure 7B:
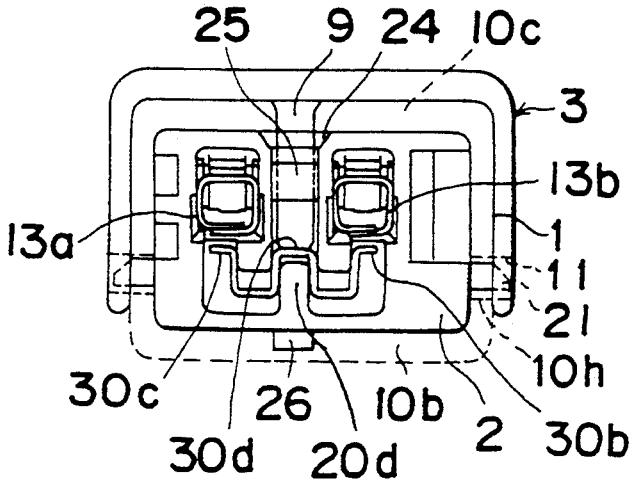
FIG. 7B is a view similar to FIG. 5B, but particularly showing the lever and male connector perfectly engaged with each other.

More specifically, as shown in FIGS. 5B and 7B, contact parts 30*b* and 30*c* are formed at both side parts of the touching member 30 by projecting the plate upward and then bending in the horizontal direction. At the same time, a depressing part 30*d* is formed at the central part of the touching member of the short-circuiting member 30 by bending the plate convexly. Since the contact parts 30*b* and 30*c* are in touch with the lower surfaces of the female terminals 13, the female terminals 13 are short-circuited. When the depressing part 30*d* is pushed down, the touching member 30 can move down such that the depressing part 30*d* is guided by the guiding part 20*d*.

As shown in FIG. 4, at the center portion of the upper wall 2*a* of the device connector 2, a hole 24 is notched from the second end portion where a male connector 4 (FIG. 6A) is inserted. This hole 24 is positioned immediately above the depressing part 30*d* of short-circuiting member 30.

A strut 25 is formed in the connection space 2S at the second end portion of the device connector 2. The strut 25 has an arched upper surface 25*a*, and is located below the top hole 24 and above the touching member of short-circuiting member 30.

Figure 1A:
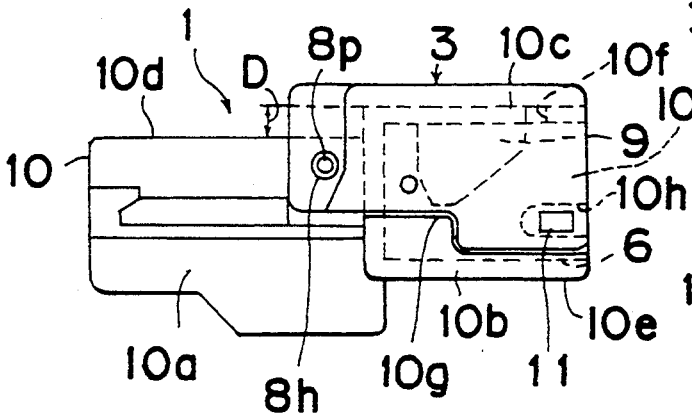
FIG. 1A is a plan view showing a female connector, according to an embodiment of the present invention, applied to the power source.
Figure 1B:
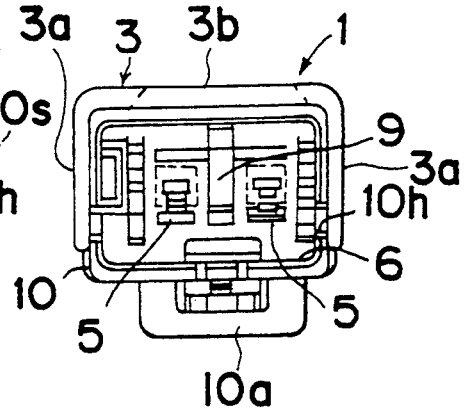
FIG. 1B is a side view showing of the female connector viewed from the right side in FIG. 1A.

Referring to FIGS. 1A and 1B, a receptacle connector 1 connected to a power source (not shown), herein after referred to as "a power connector", is shown. The power connector 1 includes a receptacle housing 10 comprised of an accommodation unit 10*a* and a receptacle unit 10*b* which are integrally formed such that a top surface of the receptacle unit 10*a* extrudes from the top surface of the accommodation unit 10*a*.

The receptacle unit 10*b* is formed in a configuration of a rectangular tube defined by a top wall 10*c*, a bottom wall 10*e*, and side walls 10*s*. One open end of receptacle unit 10*b* is closed by the front side face (right side in FIG. 1A) of accommodation unit 10*a* such that the top continually projects upward -from a top wall 10*d* of the accommodation unit 10*a* by a predetermined length D, forming a step difference D between both units 10*a* and 10*b*. Thus, a receptacle space 6 is formed in the receptacle unit 10*b*, opened at the side opposed to the accommodation unit 10*a*. Such receptacle space 6 is wide and deep enough to receive the device connector 2 therein. A stepped projecting part 10*g* is formed in each lower side part 10*s* thereof, and is raised by a predetermined amount therefrom to form a stepped pattern, as shown in FIG. 1A.

A pair of guide channels 10*h* are opened in the front lower end of side walls 10*s* above the stepped projecting part 10*g*, and opened at the open edge thereof for receiving the engaging projections 21 when the device connector 2 is inserted in the receptacle space 6.

A center portion of the top wall 10*c* is removed from the stepped corner to the back side of the open edge thereof to form an elongated through hole therein. Thus, a top hole 10*f* is formed.

As shown in FIG. 4, a temporary fitting groove 15 is formed in the lower surface of the receptacle space 6 at the center portion of the bottom wall 10*e*. Such groove 15 extends from the accommodation unit side and reaches before the open edge of receptacle unit 10*b* such that a temporary engaging part 14 is formed on the back side of the opening edge of the bottom wall 10*e*.

Referring to FIG. 3, the accommodation unit 10*a* provided with a pair of pivot pins 8*p* formed on the outside surfaces of side walls thereof and near the receptacle unit 10*b* is shown.

Referring to FIG. 6A, the accommodation unit 10*a* provided with a plurality of second terminal chambers 5 formed therein is shown. Each of such chambers 5 extends between first and second end sides thereof and in parallel to others, and only two second terminal chambers 5 are shown in FIG. 1B for the sake of brevity. A male terminal 4 having a slim and flat electric touching element 4*a* is accommodated inside each of the second terminal chambers 5 such that the touching element 4*a* protrudes from the accommodation housing 10 into the receptacle space 6.

As shown in FIG. 1B, a lever 3 having a U-shaped configuration in cross section defined by a top wall 3*b* and two side walls 3*a* rotatably provided on the accommodation unit 10*a* is shown. The lower end surface of the side walls 3*a* is formed in a stepped pattern corresponding to that of stepped projecting part 10*g* of the receptacle unit 10*b*, as shown in FIG. 1A.

The lever 3 is provided with a pair of pin holes 8*h* respectively formed in the side walls 3*a* at a corner apart from the top wall, and is further provided with a rectangular engaging hole 11 opened in the front lower end of each side wall 3*a* thereof.

The lever 3 is installed on the accommodation unit 10*a* such that each of pivot pins 8*p* is rotatably inserted in pin holes 8*h*. Thus, the lever 3 can pivot freely with respect to the pivot pins 8*p*. It is to be noted that the lever 3 can be turned in the counter-clockwise direction because of the presence of the step difference D, as best shown in FIG. 5A, until the rear end of top wall 3*b* of the lever 3 butts against the top wall 10*d* of the power connector 1.

When the lever unit 3 is turned down, the lever 3 sits over the receptacle unit 10*b* and covers the substantial part of the top wall 10*c* and side walls 10*s* of the receptacle unit 10*b* such that the lower stepped ends thereof fit the stepped projecting part 10*g*, as shown in FIG. 3. At this position, the rectangular engaging holes 11 are aligned with the guide channels 10*h* of the receptacle unit 10*b*.

Referring to FIG. 4, a projection 9 protruding downward from the lower surface of the lever 3 is shown. The projection 9 is flat plate like configuration protruding from the central portion of the top wall 3*b* and extending preferably in the insertion direction expressed by an arrow A. Along this direction, the device connector 2 is inserted in the power connector for the engagement. The flat projection 9 has a first inclined edge 9*a* inclining from the front side (opening end) to the rear side (the accommodation) thereof, a second inclined edge 9*c* inclining from the rear to front side, and a lower end edge 9*b* formed between first and second edges 9*a* and 9*c*. The lower end edge 9*b* extends in the insertion direction A. Thus formed projection 9 is located in a position and a configuration such that can be inserted in and retracted from the receptacle space 6 through the top hole 10*f* when the lever 3 is rotated down and up, respectively.

The operation for engaging power and device connectors 1 and 2 with each other and releasing the short-circuit is described below.

As shown in FIG. 3, before the engagement of the connectors 1 and 2, the lever 3 is preferably seated on the top wall 10*c* of the receptacle unit 10*b* such that the flat projection 9 is located inside the receptacle space 6 through the top hole 10*f*. It is to be noted that the lever 3 can be held at any optional position between the states shown in FIG. 3 and FIG. 5A.

The short-circuiting member 30 is set in the device connector 2 such that the contact parts 30*b* and 30*c* are kept in touch with the lower surfaces of the female terminals 13, so that the terminals 13 are short-circuited, as shown in FIG. 5B.

As indicated in FIG. 3, the device connector 2 is inserted, along the direction A, in the receptacle space 6 of the power connector 1. At this time, the lever 3 remains at the original position until it butts against the strut 25 of the device connector 2, as shown in FIG. 4.

When the strut 25 butts against the first inclined edge 9*a* of the projecting part 9 inside the receptacle space 6, the arched upper surface of the strut 25 pushes the first inclined edge 9*a* up as the device connector 2 is inserted, so that the lever 3 is turned up in the counter-clockwise direction indicated by an arrow X1, as shown in FIG. 5A and FIG. 6A with respect to the pivot pin 8*p*. The projecting part 9 of the lever 3 is pushed upward through the opening commonly occupied by the top hole 24 of the device connector 2 and the top hole 10*f* of the power connector 1.

When the temporary engaging projection 26 of the device connector 2 comes to the opening end of the receptacle unit 10*b*, the projection 26 butts against the temporary engaging part 14, and the device connector 2 temporarily stops there. By pushing the device connector 2 strongly, the projection 26 slides over the engaging part 14 by the tapered surface 26*a* thereof and enters in the temporary fitting groove 15. At this position, the engaging surface 26*b* off the temporary engaging projection 26 is meshed with the rear end surface of the temporary engaging part 14, and the device connector 2 is temporarily locked. Hereinafter this position is referred to as "a temporary engaging position".

While the device connector 2 passes over the projection 14, the strut 25 also passes through the lower end edge 9*b* of the lever 3, and then the lever 3 rotates down in an arrow direction X2 such that the strut 25 is set in the back of the second inclined edge 9*c* when the device connector 2 reaches the temporary engaging position, as shown in FIG. 5A.

It is to be noted that the temporary engaging projection 26 and the temporary engaging part 16 constitutes a first locking means which holds the connectors 1 and 2 at the temporary engaging position. Since the device connector 2 reaches the temporary engaging position after passing through the temporary engaging part 14 with a resistant force, it can be easily sensed by the operator that the connectors 1 and 2 are temporarily coupled with each other.

When the device connector 2 is moved to the temporary engaging position, the electric touching elements 4*a* of the male terminals 4 accommodated in the power connector 1 are inserted into the female terminals 13 in the device connector 2. As a result, the male and female terminals 13 and 4 are turned conductive.

Then, the lever 3 is turned in the clockwise direction indicated by an arrow X2, as shown in FIG. 5A. In accordance with the rotation of the lever 3, the strut 25 is brought in touch with the first inclined edge 9*c* of the projecting part 9 and pushed backward (in the insertion direction A) so that the rear end surface of the device connector 2 is compulsorily pressed in contact with the accommodation unit 10*a* of the power connector 1. At the same time, the engaging projection 21 is guided into the guide channels 10*h* of the receptacle unit 10*b*, and is protruding outward from the side walls 10*s*. And both connectors 1 and 2 are firmly engaged. Hereinafter this position is referred to as "a real engaging position".

The lower end edge 9*b* of the projecting part 9 pushes down the depressing part 30*d* of the short-circuiting member 30 during the rotation of the lever 3. The plate member of the short-circuiting member 30 is deflected downward so that the contact parts 30*b* and 30*c* are separated from the lower surfaces of the female terminals 13. Accordingly, the female terminals 13 are released from being short-circuited.

Figure 8:
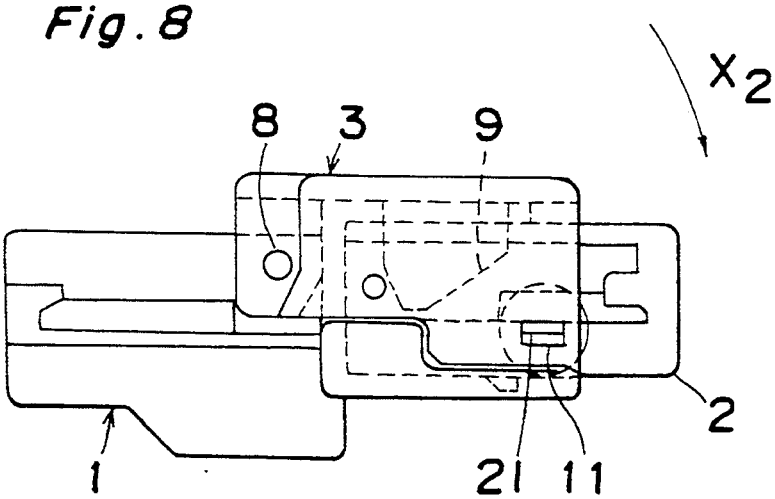
FIG. 8 is a plan view showing connectors, perfectly engaged with each other, shown in FIG. 3.

When the rotation of the lever 3 approaches the final stage, the lower end of each side wall 3*a* of the lever 3 comes into touch with the engaging projection 21 of the device connector 2 and further rides over the projection 21. Consequently, the engaging projection 21 is fitted in the engaging hole 11 formed in the side wall 3*a* at the real engaging position, as shown in FIG. 8.

As depicted hereinabove, when the device connector 2 is completely coupled with the power connector 1 by the lever 3 at the real engaging position, the lever 3 of the power connector is locked with the device connector 2. Thus, the engaging projection 21 and the engaging hole 11 constitutes a second locking means which securedly holds the connectors 1 and 2 at the real engaging position. That is, the second locking means makes the engagement of the male and female connectors 1, 2 more positive and reliable.

According to the present invention as above, not only the male and female connectors 1 and 2 are engaged with each other at the real engaging position, but the connectors 1 and 2 are locked by the first locking means at the temporary engaging position even if the engagement is missed and the device connector 2 is retreated to the temporary engaging position. The male and female connectors 1 and 2 are thus arranged to be double-locked.

On the other hand, when the device connector 2 does not reach the temporary engaging position, the strut 25 of the device connector 2 is located below the first inclined edge 9*a* of the projecting part 9. If the lever 3 is inadvertently turned in the clockwise direction in this state, the first inclined edge 9*a* comes in touch with the strut 25 to push the device connector 2 forward. As a result, the device connector 2 is pushed outside from the receptacle space 6 of the power connector 1. Accordingly, it is easily confirmed that the engagement is not effective.

As is clear from the foregoing description of the present invention, the assisting lever of the connector has the projecting part to push down the short-circuiting member when the connectors are to be perfectly engaged with each other. Therefore, the short-circuit of the terminals of the device side connector can be automatically released when the connectors are engaged. A special short-circuit releasing member is not particularly required for the connector of the power side. The present connector is simple and compact in structure.

Moreover, when the device connector 2 is inserted into the power connector 1, the lever 3 is forcibly turned to the operating position (temporary engaging position). Therefore, it is not necessary to position and hold the lever 3 at the operating position beforehand, thus enhancing the degree of freedom in the setting position of the lever prior to the engagement. Further, a mechanism for holding the lever at the operating position is dispensed with.

Since it is clearly judged by the sense of moderation that the female connector reaches the temporary engaging position, the connectors can be connected with certainty even in the case where the engagement is hard to confirm by eye.

The connectors are locked by the first locking means at the temporary engaging position while the male and female terminals in the connectors are kept conductive, and further the connectors are locked by the second locking means at the real engaging position. That is, the male and female connectors are adapted to be double-locked. It is positively prevented that the male and female connectors are detached from each other and turned so as not to be conductive.

If the lever is erroneously manipulated when the device connector 2 does not reach the temporary engaging position, the device connector 2 is pushed out in a direction to be separated from the power connector 1. Therefore, it is surely judged that the connectors are not engaged, and the engagement of the connectors is positively re-tried.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector for connecting a first terminal and a second terminal, comprising:

a first connector member for accommodating said first terminal therein and provided with first engaging means and first positioning means;

lever means pivotally provided on said first connector member, said lever means being provided with a tapered pressing means having first and second inclined edges; and a second connector member for accommodating said second terminal therein and provided with second engaging means engageable with said first engaging means, third engaging means engageable with said pressing means, and second positioning means engageable with said first positioning means for holding said first connector member and said second connector in a temporary position, said lever means being movable between a first predetermined position, in which said first and second connector members temporarily contact each other and a second predetermined position, in which said third engaging means is pressed by said at least one of said first and second inclined edges of said pressing means along said first engaging means, so that said second connector member is firmly engaged with said first connector member.

2. A connector as claimed in claim 1, wherein said first positioning means comprises a first projection means and a groove means continuously formed with said first projection means inside said first engaging means; and said second positioning means comprises a second projection formed on said second engaging means, whereby when said second connector member is pressed toward said first connector member, said first projection means passes over said first projection and fits into said groove means such that said second connector member is held at said first predetermined position.

3. A connector as claimed in claim 1, wherein said lever means further comprises fourth engaging means; and said second connector member further includes fifth engaging means provided on said second engaging means, said fifth engaging means engageable with said fourth engaging means for holding said lever means at said second predetermined position, in which said first and second connector members are firmly connected by pivoting of said lever means.

4. A connector for connecting a plurality of first terminals with a plurality of second terminals, comprising:

a first connector member for accommodating said plurality of first terminals therein and provided with a first engaging means, and short-circuiting means on said connector member, said short-circuiting means being movable into contact with said plurality of first terminals for short-circuiting said plurality of first terminals;

a second connector member for accommodating said plurality of second terminals therein and provided with second engaging means engageable with said first engaging means; and a pivoted lever means, said lever means provided with pressing means located in a position opposed to said short-circuiting means with respect to said plurality of first terminals, whereby when said first and second engaging means are temporarily engaged, said lever means thereafter being rotated such that said pressing means presses said short-circuiting means to move apart from and out of contact with said plurality of first terminals.

5. A connector as claimed in claim 4, wherein said first connector member further comprises first positioning means and a third engaging means formed between said pressing means and said plurality of first terminals, said third engaging means being engageable with said pressing means; and said second connector member including a second positioning means engageable to said first positioning means for holding said first connector member and said second connector member in a temporary position, said lever means being movable between a first predetermined position, in which said first and second connector members temporarily contact each other, and a second predetermined position, in which said short-circuiting means is released from said plurality of first terminals and said third engaging means is pressed by said pressing means along said second engaging means so that said first connector member is firmly engaged with said second connector means.

6. A connector as claimed in claim 4, wherein said first terminal is connectable to an electric device; and said second terminal is connectable to a power source.

* * * * *